United States Patent [19]

Gallagher

[11] Patent Number: 5,000,155

[45] Date of Patent: Mar. 19, 1991

[54] CONNECTOR TO EXTERNAL AIR SOURCE FOR GAS OPERATED GUN

[76] Inventor: Denis R. Gallagher, 9003 Malinda Dr., Harvard, Ill. 60033

[21] Appl. No.: 486,145

[22] Filed: Feb. 28, 1990

[51] Int. Cl.[5] ..... F41B 11/00

[52] U.S. Cl. ..... 124/71; 124/74

[58] Field of Search ..... 285/12, 351, 353; 124/56, 58, 71–74

[56] References Cited

U.S. PATENT DOCUMENTS

| | | | |
|---|---|---|---|
| 2,537,358 | 1/1951 | Lincoln . | |
| 2,713,859 | 7/1955 | Bradfield | 124/45 |
| 3,103,212 | 9/1963 | Merz | 124/74 X |
| 3,261,341 | 7/1966 | Merz | 124/74 |
| 3,269,379 | 8/1966 | Braughler et al. | 124/74 X |
| 3,618,987 | 11/1971 | Carbone | 285/12 |
| 4,004,566 | 1/1977 | Fischer | 124/59 |
| 4,150,656 | 4/1979 | Curran | 124/74 |
| 4,422,433 | 12/1983 | Milliman | 124/74 |
| 4,434,811 | 3/1984 | Murdoch | 285/351 X |

FOREIGN PATENT DOCUMENTS

| | | | |
|---|---|---|---|
| 3521800 | 9/1986 | Fed. Rep. of Germany | 124/58 |
| 52054 | 8/1943 | France | 124/56 |
| 482134 | 6/1953 | Italy | 124/56 |

OTHER PUBLICATIONS

W. W. Grainger, Inc.; Industrial and Commercial Equipment, Components, and Supplies Catalogue; No. 376 (Fall 1989); p. 1229.

McMaster-Carr Supply Company; McMaster-Carr Supply Company Catalog, No. 95/ pp. 46–47.

Crosman Air Guns, a Coleman Company, Models 357 Six and 357 Four Owners Manual.

*Primary Examiner*—Peter M. Cuomo
*Assistant Examiner*—John A. Ricci
*Attorney, Agent, or Firm*—James P. Hanrath

[57] ABSTRACT

A connector to an external air source for a gas-operated gun having a cartridge piercing receiving assembly, including a threaded flange skirt and a hollow cartridge piercing-needle, and an opening to permit extension of an air conduit from the gas-operated gun to a pressurized air source external of the gun comprises a connector body and a nose bushing intregal to one end thereof. An air conduit extends through axially aligned passage bores of the nose bushing and connector body, a seating end of which is internal to the gun and is fixly held in air tight communication over the hollow piercing-needle of a cartridge piercing assembly when the nose bushing, which is threaded at its outer annual periphery, is threadedly engaged with a threaded annular inner wall of the flange skirt. The end of the air conduit external to the gun is fixly held within a connector assembly or plug engaged in a quick change coupler in communication with a pressurized air source external to the gas-operated gun or a quick change coupler of a manifold capable of communication with the external air source. Alternatively, a bored guide cap within a threaded upper outer annular periphery may be provided to threadedly engage the threaded flange skirt and receive, at its inner planar or tapered surface, respectively, a non-threaded spout or a tapered neck and non-threaded spout, respectively, of other embodiments of the connector body which is rearwardly supported by either a thumbscrew or spring coil system.

18 Claims, 7 Drawing Sheets

CONNECTOR TO EXTERNAL AIR SOURCE FOR GAS OPERATED GUN

BACKGROUND OF THE INVENTION

1. Field of the Invention

The present invention is related to an improvement in gas-operated guns, pistols, rifles and the like and more particularly, to a connector whereby gas-operated guns having a cartridge-piercing assembly, including a threaded flange skirt, and utilizing a hollow-piercing needle to engage a pressurized gas cartridge internal to the firearm can be easily converted to use an external source of compressed gas for shooting projectiles therefrom.

2. Description of the Related Art Including Information Disclosed under 37 CFR Sections 1.97–1.99

A variety of gas-operated guns, pistols, rifles and the like are known which shoot projectiles by a power source of a pressurized air cartridge or bottle set internal to the firearm. Such cartridges commonly contain nitrogen, oxygen or carbon dioxide under relatively high pressure, and are usually miniaturized in design to be readily insertable into a handle or other portion of a firearm for communication with a cartridge piercing receiving assembly. Air source cartridges, while under pressure, cannot be mutilated or incinerated, exposed to extreme heat or stored above 120 degrees.

Miniaturized air source cartridges provide a limited internal power source for the gun which is quickly exhausted, necessitating disposal for replacement by another miniaturized air source cartridge. For example, U.S. Pat. No. 4,422,433 to Milliman illustrates an air gun which utilizes a pressurized air cartridge set within the handle of the gun. The gun illustrated in the Milliman Patent is commonly referred to as a Crosman AirGun which fires 1.77 caliber pellets utilizing a 12 gram Powerlet CO2 air cartridge. Crosman AirGun and Powerlet are registered Trademarks of the Coleman Company. However, after approximately sixty shots of the Crosman AirGun (depending upon temperature) the pressurized gas cartridge internal to the firearm is spent, thus requiring the firearm user to properly discard the spent cartridge and replace it with another pressurized gas cartridge for the next sixty shots.

The connector to external air source for gas-operated guns of the present invention replaces and is an alternative to pressurized gas cartridges set internal to a gun and particularly, is designed to alleviate the need for disposal of spent miniaturized air source cartridges and replacement of the same by allowing the gas-operated gun to utilize a higher capacity pressurized air source bottle external to the gun. High capacity pressurized air bottles can accommodate thousands of shots of a gun, are commercially available, and are refillable eliminating the need for disposal.

Examples of gas operated guns are disclosed in the following United States Patents:

| U.S. Pat. No. | Patentee |
|---|---|
| 4,422,433 | Milliman |
| 4,004,566 | Fischer |
| 2,713,859 | Bradfield |
| 2,537,358 | Lincoln |

Gas-operated guns have utilized internal pressurized air cartridges. In U.S. Pat. No. 4,422,433 to Milliman, pressurized gas is supplied to a valve body by a carbon dioxide cartridge which is mounted inside the handle portion of the gun. The carbon dioxide gas flows through a cartridge piercing assembly 37 and through a connecting tube assembly 38 to valve body 25, where, upon firing, pressurized carbon dioxide is allowed to flow from the valve body through specified openings in the inside of a valve stem 23 to fire a projectile. Milliman notes that the gun may be powered by gases other than carbon dioxide, e.g., pressurized air.

Gas-operated guns have also utilized an external air source. For example, U.S. Pat. Nos. 4,004,566 to Fischer and 2,713,859 to Bradfield disclose pressurized air operated guns which utilize a supply of compressed air external to the gun. Fischer discloses a supply line connected to the hand grip of a gun which includes a conduit 20 which leads from a supply of compressed gas external to the gun to the gun housing. Likewise in Bradfield, there is disclosed a pressure supply hose 7 which leads from a source of relatively high air or gas pressure external to the gun.

In U.S. Pat. No. 2,537,358 to Lincoln there is disclosed an adaptor whereby conventional hand air pump firearms can be converted into a gas cartridge operated gun by having its hand air pump removed for replacement by a compressed gas cartridge.

SUMMARY OF THE INVENTION

The connector to external air source for a gas-operated gun of the present invention replaces a miniaturized pressurized air cartridge internal to a firearm which is pierced with a hollow needle of a cartridge piercing receiving assembly with an air supply conduit held within aligned axial passage bores of a nose bushing integral with a connector body to provide pressurized air from a source external to the firearm. The connector body can be generally in a cylindrical or rectangular shape dimension such as to readily replace a miniaturized air cartridge. A brass compression fitting supplemented by elastic o-rings at its upper and lower portions is mounted upon the air supply conduit near a seating end thereof and is secured within the passage bore of the nose bushing so as to permit a portion of the air conduit to extrude outward beyond the planar face of the nose bushing. The nose bushing is threaded at its outer annular periphery and is of sufficient diameter to threadedly engage a threaded annular inner wall of a cartridge piercing receiving assembly flange skirt. Upon threaded engagement, the seating end of the air conduit is set over the extended end of the hollow piercing-needle in fixed communication therewith and in air tight or sealed engagement.

Alternatively, other embodiments of the present invention provide that an externally threaded guide cap of sufficient diameter may be used to threadedly engage the threaded annular inner wall of the flange skirt and to receive a non-threaded spout of a connector body rearwardly supported by a spring or thumb screw system within the guide cap's interior. In such embodiments, a thumb-screw or spring system cooperating with a base below the connector body is provided to engage the bottom of the connector body for upward movement to the guide cap's interior such as to support the same and fixly hold the extruded seating end of the air conduit in air tight or sealed engagement over the hollow piercing-needle of the cartridge piercing assembly of the firearm.

In all embodiments of the present invention the air conduit extends through an outlet of the firearm to a supply end of the air conduit external of the gun which is fixly held within a connector assembly for engagement within a quick change coupler capable of engaging a receiving connector of an external pressurized air source. The length of the air conduit should be sufficient to allow the firearm user to conveniently use the firearm without hinderance.

Additionally, the connector assembly fixly holding the external supply end of the air supply conduit can be engaged within a quick change connector threadedly inserted into a manifold having a plurality of threaded holes to threadedly receive a corresponding plurality of quick change couplers. The plurality of threaded holes in the manifold extend into a singular longitudinal cavity which is threaded at its inner annular wall near its open end to receive either a threaded connector or a threaded quick change coupler capable of engaging a receiving connector of an external pressurized air source. Usage of the manifold thus permits the external pressurized air source to accommodate a plurality of firearms utilizing the present invention.

The connector to external air source for gas-operated guns having a cartridge-piercing assembly, including a threaded flange skirt, and a hollow piercing-needle of the present invention removes the miniaturized compressed air cartridge power source from internal to a firearm and allows one or more gas-operated guns to utilize a larger capacity pressurized air bottle external to the firearm as a power source. Larger capacity air source bottles are beneficial in that they are more economical, can be refillable, are more readily available commercially, and alleviate the need for proper disposal of miniaturized air cartridges.

According to the invention, there is provided a connector to an external air source for use in a gas-operated gun having a cartridge piercing receiving assembly, including a threaded flange skirt and a hollow cartridge piercing-needle, and a gun frame having an opening to permit extension of an air conduit from said hollow piercing-needle to a pressurized air source external of said gun, comprising: a connector body having a passage bore; a nose bushing integral to one end of said connector body having a passage bore at least partially axially aligned with the passage bore of said connector body, said nose bushing being threaded at its outer annular periphery and of sufficient diameter to threadedly engage an annular inner wall of a cartridge piercing receiving assembly flange skirt; an air conduit extending through said axially aligned passage bores, a seating end of said conduit, internal to said gun, is adapted for communication with a hollow piercing-needle of the cartridge piercing receiving assembly and a supply end of said conduit, external to said gun, is adapted for connection to means for engaging a pressurized air source external to the gas-operated gun; and means for holding said seating end of the air conduit in air tight connection with said hollow piercing-needle of a cartridge piercing assembly.

Also according to the present invention there is provided a connector to external air source for use in a gas-operated gun having a cartridge piercing receiving assembly, including a threaded flange skirt and a hollow cartridge piercing-needle, and a gun frame having an opening to permit extension of an air conduit from said hollow piercing-needle to a pressurized air source external of said gun, comprising: a connector body having a passage bore; a guide cap having a central bore at a substantially planar top surface and a threaded outer annular periphery atop an outwardly extending brim flange of sufficient diameter to threadedly engage an annular inner wall of a cartridge piercing assembly flange skirt; a spout integral to one end of said connector body received into said guide cap by means for engaging said spout into said guide cap, said spout having a passage bore at least partially axially aligned with the passage bore of the connector body; an air conduit extending through said axially aligned passage bores, a seating end of said conduit, internal to said gun, is adapted for communications with a hollow piercing-needle of the cartridge piercing receiving assembly through the central bore of the guide cap and a supply end of said conduit, external to said gun, is adapted for connection to means for engaging a pressurized air source external to the gas-operated gun; and means for holding said seating end of the air conduit in air tight connection with said hollow piercing-needle of a cartridge piercing assembly.

Additional features and advantages of the present invention will become apparent to those skilled in the art from the following description and accompanying figures illustrating the preferred embodiment of the invention, the same being the present best mode for carrying out the invention.

BRIEF DESCRIPTION OF THE DRAWINGS

The foregoing and other features of the present invention will be more fully understood after reading the following description which refers to the illustrative embodiment shown in the accompanying drawings wherein.

DESCRIPTION OF THE PREFERRED EMBODIMENT

Figure 1:
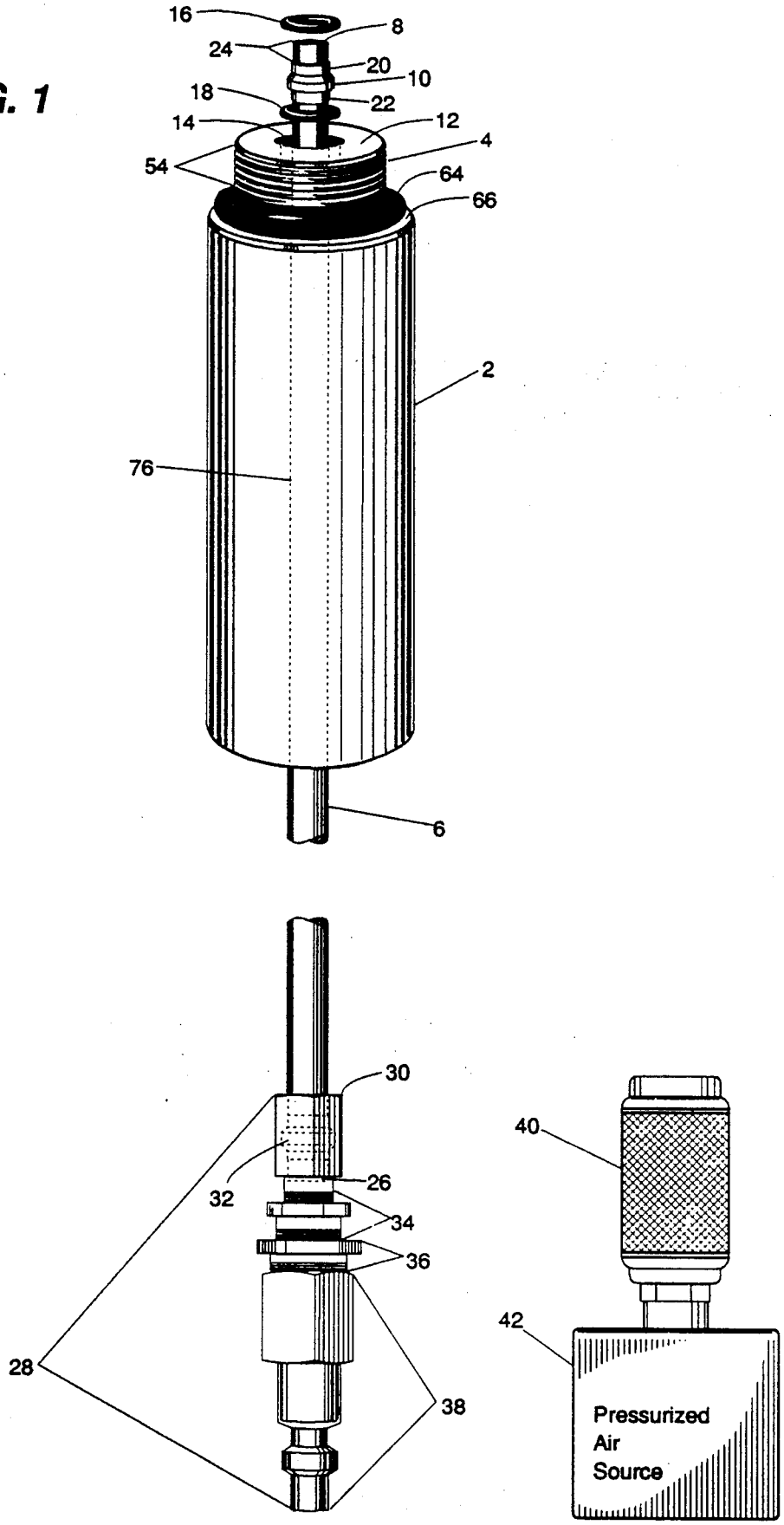
FIG. 1 is an enlarged perspective vertical view, partly exploded, of one embodiment of a connector to an external air source for a gas-operated gun constructed according to the teachings of the present invention and shows an exteriorly threaded nose bushing integral with a connector body and an air supply conduit extending through aligned axial passage bore for connection into a connector assembly capable of being engaged into a quick change coupler in communication with a pressurized air source external of the gun.
Figure 3:
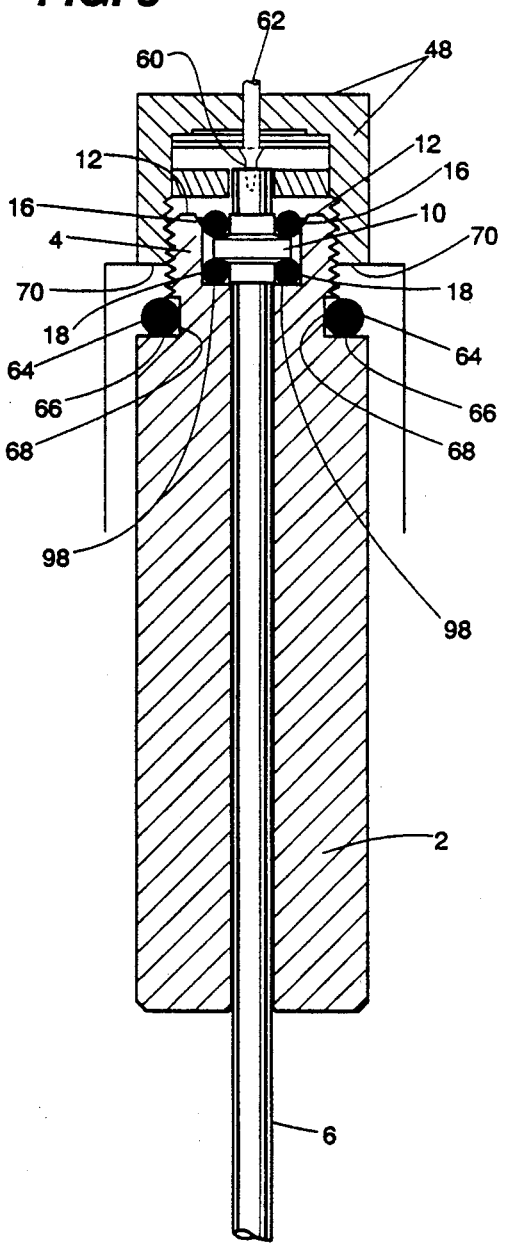
FIG. 3 is an enlarged cross-sectional view of the connector to external air source and shows the connector partially threaded onto the threaded flange skirt of a cartridge piercing assembly such that the extruded seating end of the air conduit is yet to fully seat over the hollow piercing-needle of the cartridge piercing assembly.
Figure 4:
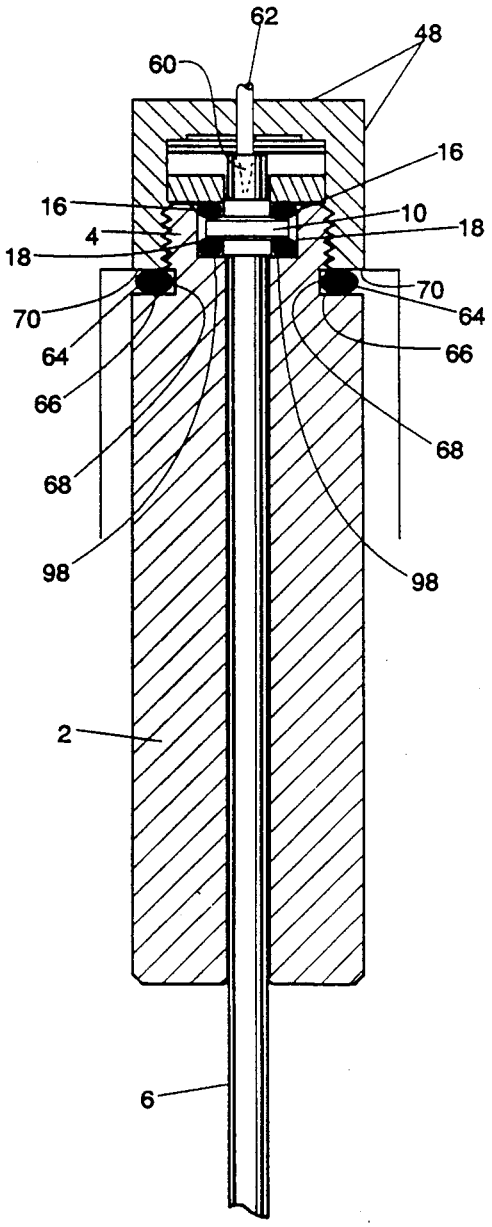
FIG. 4 is an enlarged cross-sectional view of the connector body to external air source similar to FIG. 3 and shows the connector fully threadedly engaged to the inner annular wall of the flange skirt of the cartridge piercing assembly such as to fully set the seating end of the air conduit over the hollow piercing-needle of the cartridge piercing assembly.

Referring now to the drawings, and more particularly to FIG. 1, there is shown an enlarged perspective view of the connector to external air source for gas-operated gun of the present invention which comprises a connector body 2 with a nose bushing 4 integral to the upper end of said connector body. Nose bushing 4 is externally threaded and of sufficient diameter at its exterior annular periphery to threadedly engage the internal threads of an annular inner wall of a pressurized gas cartridge receiving assembly flange skirt. The nose bushing and connector body have an at least partially aligned axial passage bore to provide a hollow passage through which an air conduit 6 can be extended. The air conduit 6 is fitted near its seating end 8 with a compression fitting 10 such as to permit the air conduit to extrude beyond the planar face 12 of the nose bushing when the air conduit is fully set within the passage bore 14 of the nose bushing. The compression fitting 10 is supplemented by a pair of elastic o-rings 16 and 18 which will seat upon an upper portion 20 and lower portion 22 of the compression fitting respectively when the compression fitting 10 and air conduit 6 is held in fixed relation in nose bushing passage bore 14 (see FIG. 3 and 4). As shown in FIG. 3 and FIG. 4, the extruded end 24 of the air cord extends approximately one-sixteenth to one-eighth of an inch outward from the planar face 12 of the nose bushing in order to seat over a hollow cartridge piercing-needle of the cartridge piercing receiving assembly upon full threaded engagement of the nose bushing with the threaded annular inner wall of the flange skirt.

Air conduit 6 is illustrated in FIG. 1 as being fragmented, and the length of the air conduit can be adjusted to the desires and convenience of the gas-operated gun user. In this regard, the length should be sufficient to permit usage of the gas-operated gun in a safe manner without restriction or interference with the external pressurized air source.

FIG. 1 illustrates the supply end 26 of the air cord external of the gas-operated gun held within a connector assembly 28. Connector assembly 28 may be a single integral unit or may be formed of four cooperating parts or portions, namely a nut, compression fitting, reducing bushing, and plug. Nut 30 contains an internal ferrule 32 engaged upon the air cord 6 near supply end 26. The nut 30 is threadedly engaged to an upper end of a compression fitting 34. Compression fitting 34 is threadedly engaged at its lower end into reducing bushing 36. The reducing bushing 36 is threadedly received into plug 38.

Figure 10:
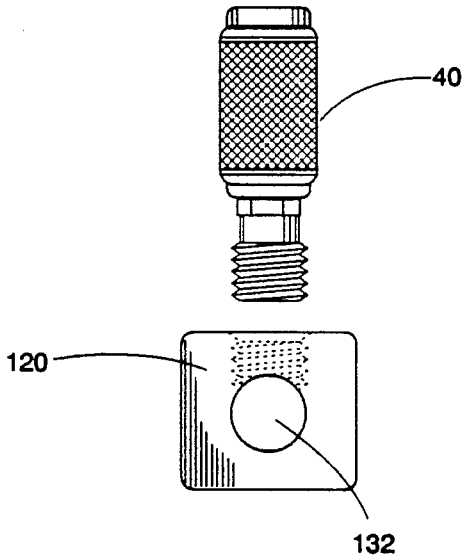
FIG. 10 is a side perspective view of a quick change coupler ready to be threadedly engaged into a threaded receiving hole of the manifold.

The particular connector assembly illustrated at FIG. 1 is adapted to engage a quick change coupler such as quick change coupler 40 shown at FIG. 1 and FIG. 10 of the drawings. A quick change coupler 40 is known in the art and provides for a quickly disengageable air tight locked securement of plug 38 of the connector assembly 28 into the coupler 40 at one of its ends and threadedly engages a pressurized air source 42 external to the gun at its other end.

Figure 8:
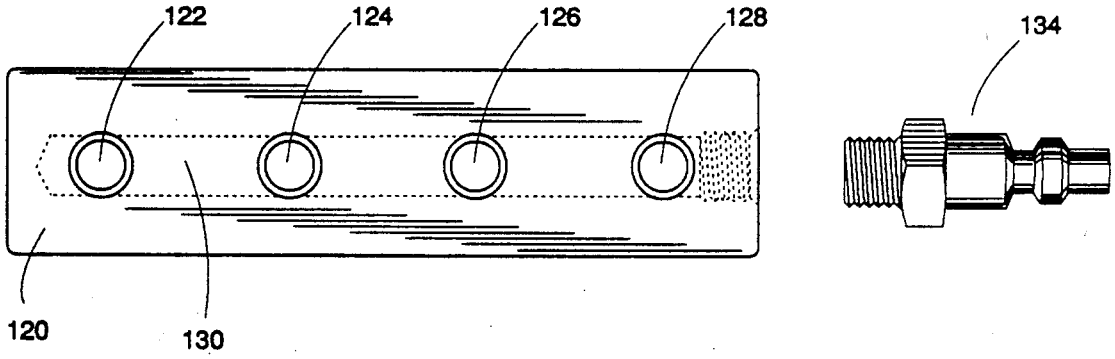
FIG. 8 is a top view of a manifold for use with the connector to an external air source for a gas-operated gun, and a connector plug adapted at one end to threadedly engage a threaded annular inner wall of a longitudinal cavity of the manifold and at the other end to engage a quick change coupler.

Quick change couplers such as style "M" of the Milton Coupler Company are appropriate as a quick change coupler for the connector assembly shown in FIG. 1 and FIG. 10. Connector assembly 28 and quick change coupler 40 in FIG. 1 and FIG. 10 are but one of many air coupler and connector combinations or air coupler and plug combinations which can be readily obtained commercially and fulfill the purpose of securing the external supply end 26 of air cord 6 in a connector assembly or plug for air flow cooperation with a coupler in communication with a pressurized air source external of the gun. For example, W. W. Grainger, Inc., headquartered at 5959 West Howard Street, Chicago, Ill. 60648, periodically publishes an INDUSTRIAL AND COMMERCIAL EQUIPMENT, COMPONENTS, AND SUPPLIES CATALOGUE, such as number 376 (Fall 1989) which at page 1229 lists their own SPEEDAIRE (trademark) line of sleeve or push type female or male couplers for use with male or female plugs and complete coupler assemblies, all in various National Pipe Thread sizes. Other nationwide companies do likewise, such as the catalogue number 95 of McMaster CARR Supply Company, P.O. Box 4355, Chicago, Ill., 60680-4355, which at pages 46–47 offer similar coupler (sockets) and connector plugs. Applicant hereby incorporates by reference said pages of the W. W. Grainger Inc. and McMaster CARR catalogues for the purpose of indicating the state-of-the-art for connector assemblies, plugs, quick change couplers, couplers, and complete coupler assemblies. It is observed that FIG. 1, FIG. 8, and FIG. 10 illustrate only one embodiment of a connector assembly, a connector plug, and a quick change coupler from a multitude of possible configurations or combinations of such parts. Accordingly, the claims as hereinafter defined should not be limited by the particular illustrative embodiments thereof.

Figure 2:
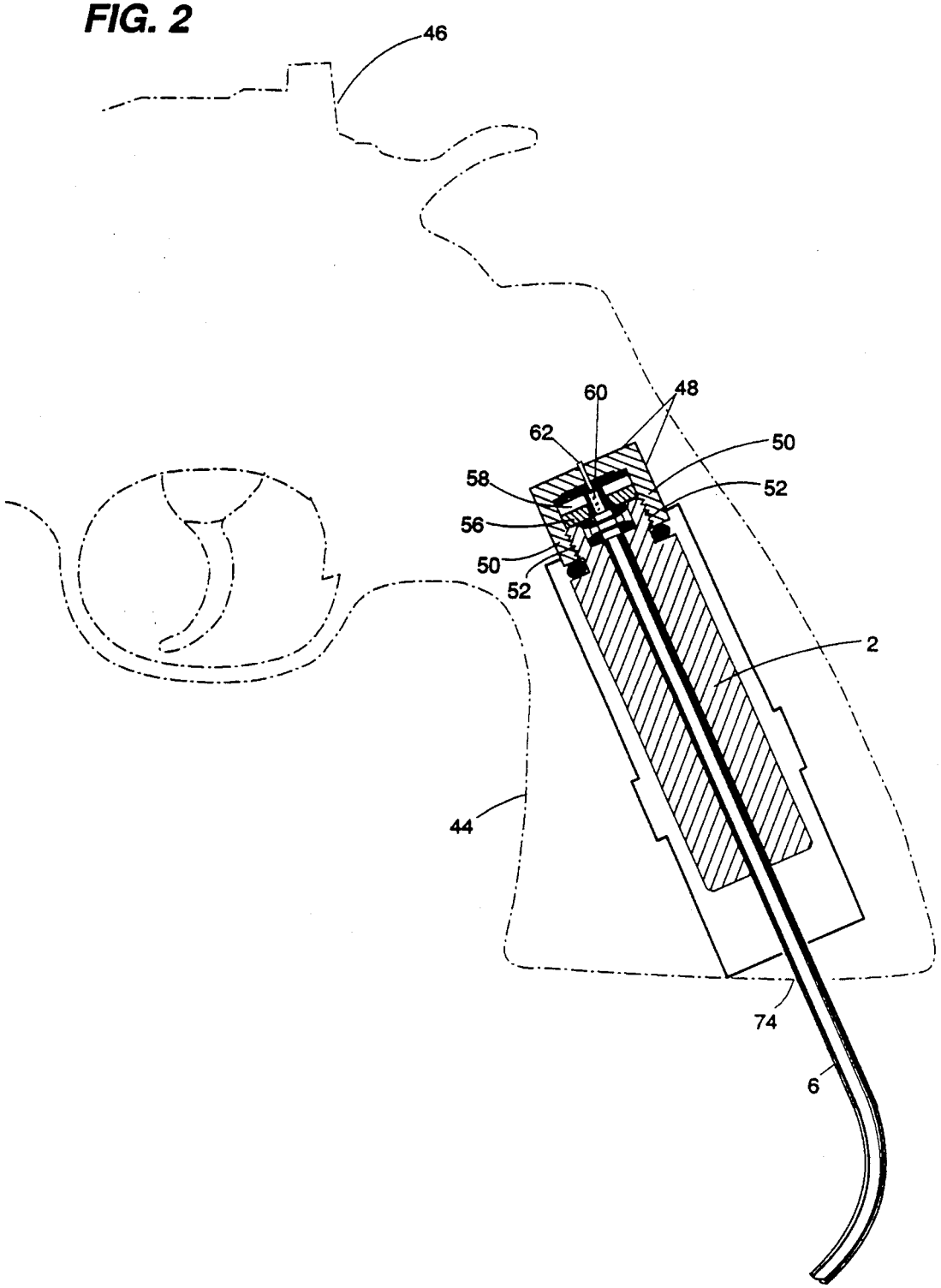
FIG. 2 is a cross-sectional view of the connector to external air source seated within the internal cartridge piercing receiving assembly of a fragmented silhouetted gun.
Figure 6:
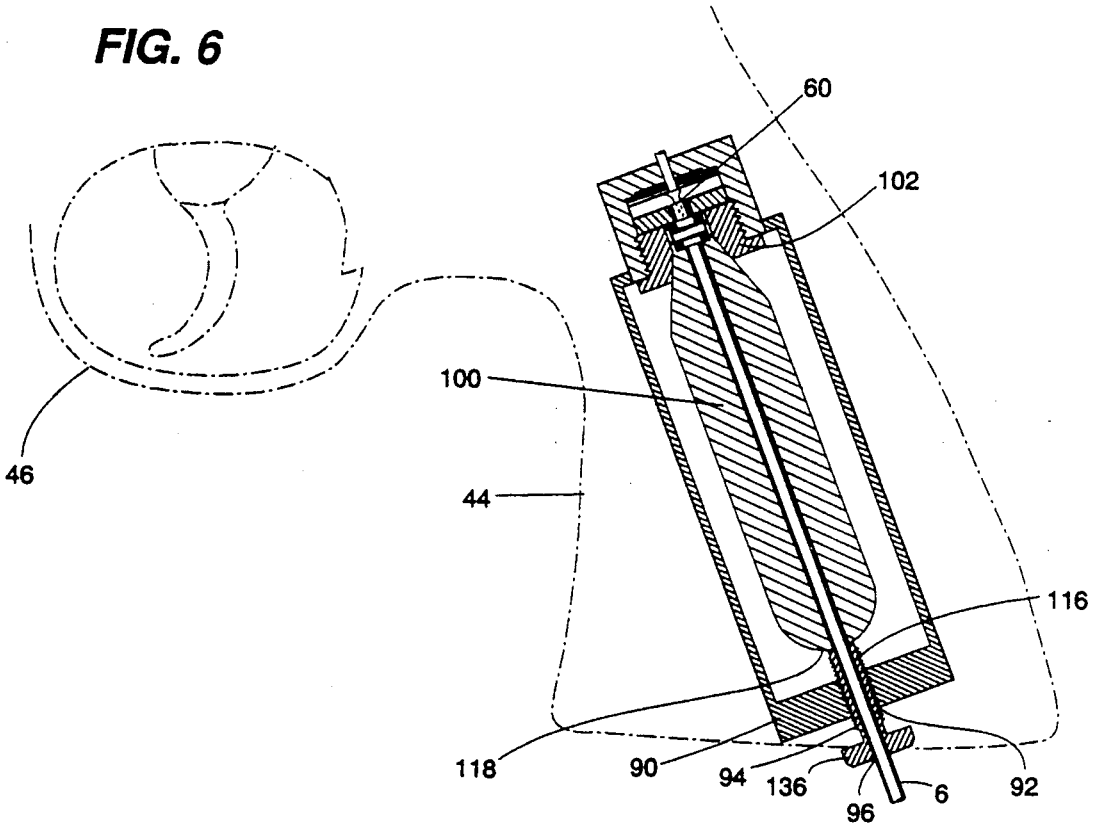
FIG. 6 is a cross-sectional view of the second embodiment of the connector to external air source illustrated in FIG. 5 and shows the connector body rearwardly set within a guide cap threadedly engaged to the internal cartridge piercing receiving assembly of a fragmented silhouetted gun by means of a thumbscrew system.
Figure 11:
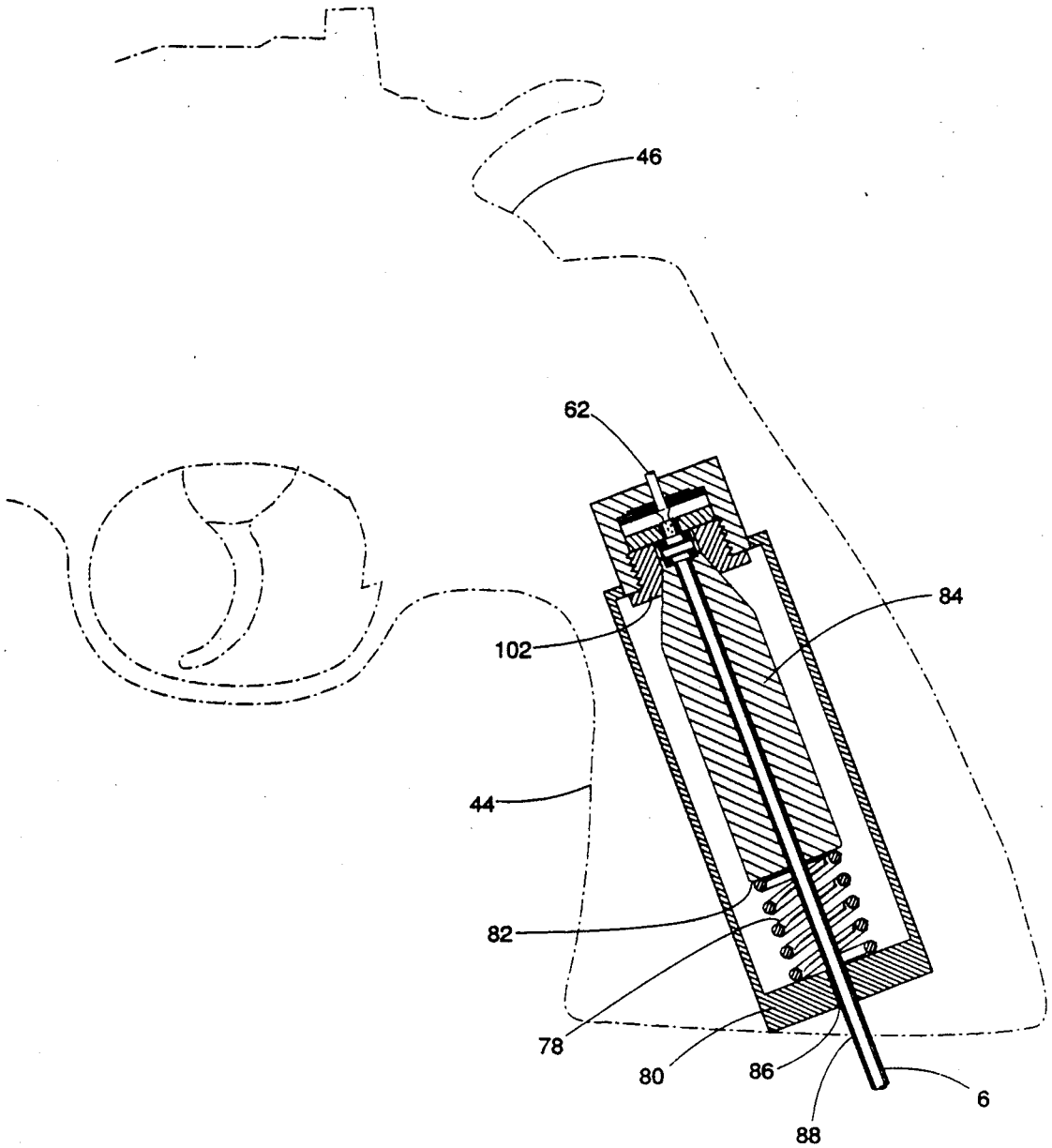
FIG. 11 is a cross-sectional view of a third embodiment of the connector to external air source for a gas-operated gun constructed according to the teachings of the present invention and shows a connector body rearwardly set within a guide cap threadedly engaged to the internal cartridge piercing receiving assembly of a fragmented silhouetted gun by means of a coil spring supported upon a chamber base for tension engagement with a planar rear surface of the connector body.

Referring now to FIG. 2, FIG. 6, and FIG. 11 there is shown sectional views of three embodiments of the connector to external air source for a gas-operated gun of the present invention set within the handle 44 of a fragmented silhouetted gun 46 in replacement of an internal gas cartridge. In FIG. 2, a first embodiment of the connector to external air source is shown fully received into a cartridge piercing receiving assembly 48 of the gas-operated gun. The cartridge receiving assembly 48, which is also illustrated in enlarged form at FIG. 7, includes flange skirt 50 which is threaded at its annular inner wall 52 to threadedly engage the threaded outer annular periphery 54 (seen at FIG. 1) of nose bushing 4. Upon full threaded engagement, the planar face 12 of nose bushing 4 is seated flush against a washer 56 abuting against a cartridge piercing receiving assembly receiving disc 58. The receiving disc 58 has a hole at its center into which a cartridge piercing-needle 60 extends approximately ½ way downward into the hole of washer 56. The hollow piercing-needle 60 was originally designed to pierce the cap of a miniaturized pressurized air cartridge set internal to the gun such as to provide gas communication from the miniaturized pressureized air cartridge to a valve outlet 62 leading to a valve system of the firearm (valve system not shown in drawings). When the nose bushing 4 of the connector body 2 is fully threadedly engaged into the cartridge piercing receiving assembly 38, as shown in FIG. 2, and FIG. 4, the extruding seating portion 24 of the air conduit 6, which extends beyond the planar face 12 of the nose bushing, is aligned over the hollow cartridge piercing-needle 60 in air tight or sealed connection. In this regard FIG. 4 illustrates the elastic o-rings 16 and 18 at the upper and lower portions 20 and 22, respectively, of the compression fitting 10 in a compressed state to maintain an air tight seal of nose bushing passage bore 14. A third larger elastic o-ring 64 seated upon a shoulder 66 and surrounding a neck 68 of the connector body 2 is likewise in a compressed state in abutment against a bottom outer edge 70 of the flange skirt when the nose bushing is fully threadedly engaged with the cartridge piercing receiving assembly.

Figure 5:
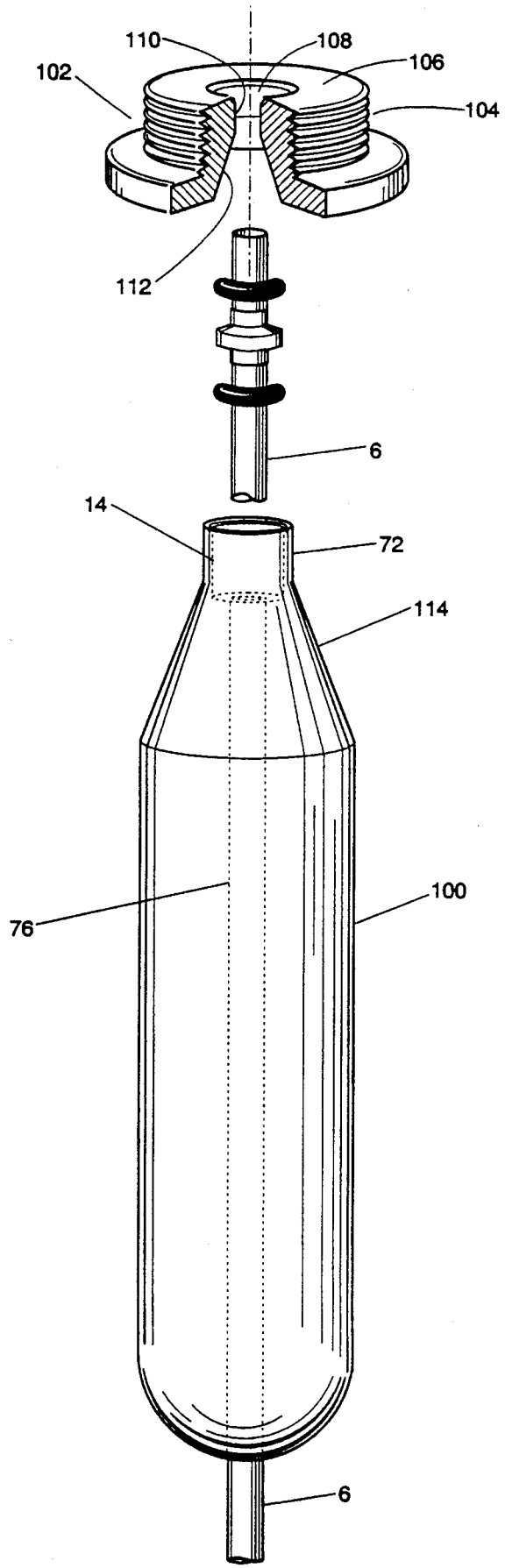
FIG. 5 is an enlarged perspective vertical view, partly fragmented and exploded, of a second embodiment of the connector to external air source for a gas-operated gun constructed according to the teachings of the present invention and shows the connector body capable of use with a threaded guide cap.

As shown in FIG. 2, 6, and 11, the air conduit 6 extends downwardly from the hollow cartridge piercing-needle through either nose bushing 4 or spout 72 of a connector body, through the connector body, for exit out of the gun handle 44 at an opening thereof, such as opening 74 of FIG. 2. FIG. 1 and FIG. 5 illustrate a larger diameter passage bore 14 in nose bushing 4 and spout 72 respectively in at least part axial alignment with smaller diameter connector body passage bore 76 to permit such extension of air cord 6. If not pre-existing in the gas-operated firearm, opening 74 can be drilled into a gun frame when converting the firearm for usage with a connector to external air source of the present invention. Similarly, an opening in the gun frame may cooperate with a coil or screw system to permit passage of the air cord from the firearm. For example, FIG. 11 illustrates a coil spring 78 supported upon a chaber base 80 for tension engagement with a planar rear surface 82 of the connector body 84. Air conduit 6 extends from connector body 84 downward inside coil spring 78 through passage bore 86 of chamber base 80 for exit from opening 88 of gun frame 44. Further, in FIG. 6 there is shown a chamber base 90 having threaded passage bore 92 therethrough capable of threadedly engaging a thumb screw 94. Thumb screw 94 has central axial passage bore 96 to permit passage of the air cord through chamber base 90 and thumb screw 94 to a point external of the gun.

In FIG. 3 there is shown a sectional view of the connector to an external air source just prior to seating upon the hollow piercing-needle 60 of a cartridge piercing assembly 48. As seen in FIG. 3 and FIG. 4, nose bushing passage bore 14 is of a diameter greater than aligned axial connector body passage bore 72. The greater diameter of the nose bushing bore accommodates the diameter of the compression fitting 10 and elastic o-rings 16 and 18 at the upper and lower portions 20 and 22, respectively of the compression fitting. As illustrated in FIG. 3, when the compression fitting and o-rings are drawn within the bore of the nose bushing lower compression fitting o-ring 18 rests at shelf 98 of the bore and upper compression fitting o-ring 16 extends partially outward of the planar surface 12 of the nose bushing. FIG. 3 also illustrates the larger elastic o-ring 64 set atop a shoulder 66 of the connector body surrounding the nose bushing at neck 68. O-rings 16, 18, and 64 are not compressed upon the partial engagement of the threaded nose bushing to the threaded annular inner wall of the flange skirt.

In FIG. 4 there is shown a sectional view of the connector to an external air source upon being fully seated over the hollow piercing-needle of a cartridge piercing assembly. Here, elastic o-rings 16 and 18 are compressed within the axial bore of the nose bushing to prevent leakage of air through the axial bore. Likewise, larger elastic o-ring 64 seated upon shoulder 66 and surrounding neck 68 of the connector body is also compressed upon full threaded engagement of the connector body to the cartridge piercing receiving assembly such as to prevent leakage of air through the threaded surfaces of the cartridge piercing assembly flange skirt and threaded periphery of the nose bushing.

FIG. 5 illustrates an enlarged perspective view of a second embodiment of the connector body to external air source wherein a non-threaded spout 72 of the connector body 100 is adapted for use with a threaded guide cap 102. The threaded guide cap 102 is threaded at upper annular periphery 104 and is of sufficient diameter to threadedly engage a threaded annular inner wall of a flange skirt of a pressurized gas cartridge receiving assembly. Guide cap 102 has a substantially planar top surface 106 which, upon full engagement of the threaded guide cap with the threaded flange skirt, will abut to washer 56 (see FIG. 7). In FIG. 5 the guide cap is illustrated as having a central bore 108 consisting of two portions. An upper portion 110 is substantially planar to capture the spout 72 of connector body 100. The lower portion 112 is tapered outward to capture the tapered neck 114 of connector body 100. However, the guide cap may have a planar singular central axial bore to capture an elongated spout of the connector body.

FIG. 6 and FIG. 11 each illustrate a means for supporting a connector body having a non-threaded spout, such as connector bodies 100 or 84, in fixed engagement within threaded guide cap 102. In FIG. 6 thumb screw 94 having an axial passage bore 96 to permit extension of air conduit 6 therethrough is screwed by operation of thumb screw handle 136 into a threaded hole 92 of a chamber base 90 such that distal end 116 of the screw engages the bottom surface 118 of the connector body and holds the same in fixed position into guide cap 102. In FIG. 11 there is shown a coil spring 78 upon chamber base 80 for tension engagement with a planar rear surface 82 of the connector body 84 such as to fixly hold said connector body within guide cap 102.

Figure 7:
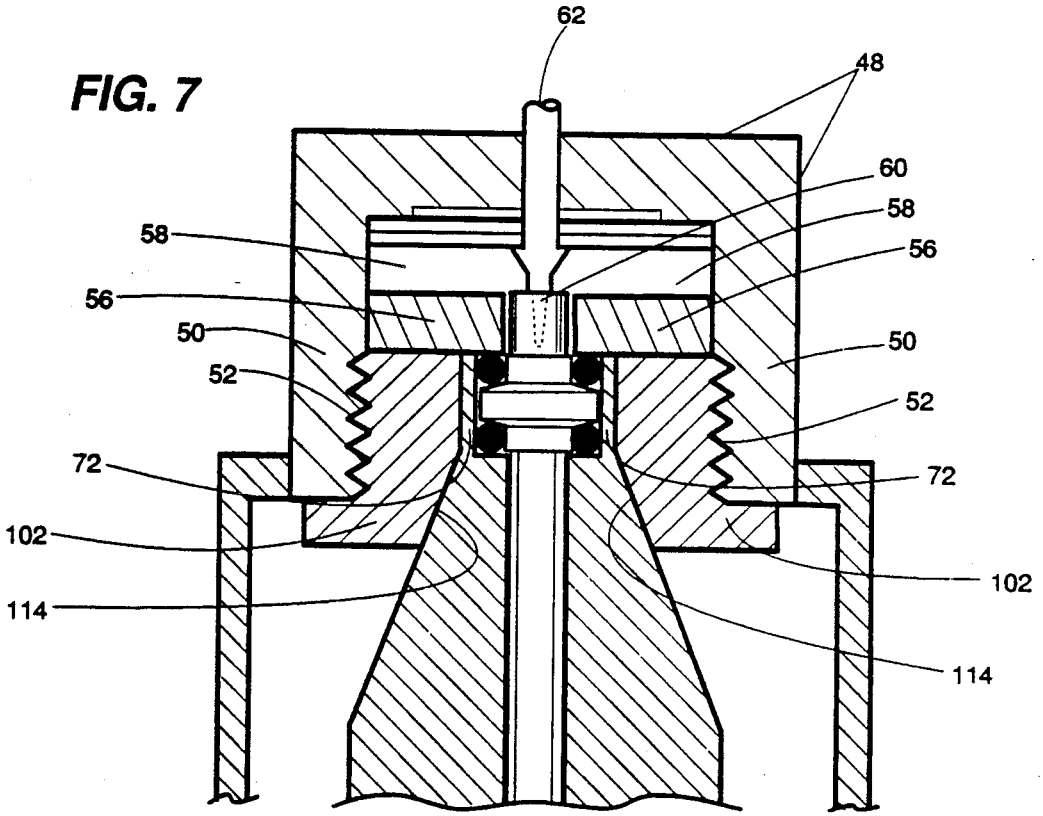
FIG. 7 is an enlarged fragmentary cross-sectional view of the second embodiment of the connector to external air source illustrated in FIG. 6 and shows a guide cap threadedly engaged to a cartridge piercing receiving assembly and the tapered neck and nonthreaded spout of the connector body within the guide cap.

FIG. 7 is an enlarged sectional view illustrating the tapered neck 114 and spout 72 of connector body 100 or 84 fully seated within threaded guide cap 102. The central axial bore 108 of the guide cap consists of two portions, an upper planar wall 110 and lower outwardly tapered wall 112. The upper planar wall 110 captures the spout 72 of the connector body while the lower outwardly tapered wall 112 captures the tapered neck 114 of the connector body.

Figure 9:
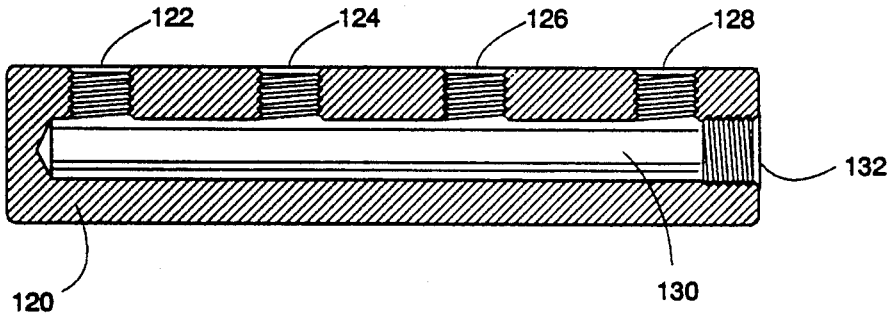
FIG. 9 is a longitudinal cross-sectional view of the manifold and shows a plurality of threaded holes extending into a longitudinal cavity which is threaded at its open end.

In FIG. 8, FIG. 9, and FIG. 10 there is illustrated a manifold 120 which can be used with the connector to an external air source to accommodate one or more firearms using the present invention with a singular external pressurized air source. FIG. 8 shows a top view of the manifold which has a plurality of threaded holes 122, 124, 126, and 128 extending into a longitudinal cavity 130. The threaded holes are adapted to threadedly receive a corresponding plurality of quick change couplers, such as coupler 40 of FIG. 10, capable of engaging up to a corresponding plurality of connector assemblies or plugs internally holding the external supply end 26 of an air conduit 6 pursuant to the teachings of the present invention. As illustrated in FIG. 9, the lower end of the threaded holes 122, 124, 126, and 128 lead into longitudinal cavity 130 which has a horizontal opening 132 which is also threaded to receive a connector plug 134. Connector plug 134 can be engaged into a quick change coupler in communication with a pressureized air supply external of the gun. Thus, a pressurized air supply can be channeled from the air supply container external of a firearm to a quick change coupler engaged therewith through connector plug 134 to longitudinal cavity 132 and communicated through a plurality of threaded holes by quick change couplers inserted therein. FIG. 10 illustrates a quick change coupler 40 prior to being threadedly engaged into a threaded receiving hole of the manifold. As the quick change coupler provides for air tight sealment of the threaded holes, all threaded holes must receive a quick change coupler to maintain the air tight seal of the manifold.

It is believed that the connector to external air source of the present invention in its described embodiment and with its numerous attended advantages will be fully understood from the foregoing description, and that changes may be made in form, construction, and arrangement of the several parts thereof without departing from the spirit or scope of the invention, or sacrificing any of the attendant advantages. The structures herein disclosed are a preferred embodiment for the purpose of illustrating the invention. Accordingly, the scope of the invention is only to be limited as necessitated by the accompanying claims.

I claim:

1. A connector to an external air source for a gas-operated gun having a cartridge piercing receiving assembly, including a threaded flange skirt and a hollow cartridge piercing-needle, and a gun frame having an opening to permit extension of an air conduit from said hollow piercing-needle to a pressurized air source external of said gun, comprising:

A. a connector body having a passage bore;

B. a nose bushing intergral to one end of said connector body having a passage bore at least partially axially aligned with the passage bore of said connector body, said nose bushing being threaded at its outer annular periphery and of sufficient diameter to threadedly engage an annular inner wall of a cartridge piercing receiving assembly flange skirt;

C. an air conduit extending through said axially aligned passage bores, a seating end of said conduit, internal to said gun, is adapted for communication with a hollow piercing-needle of the cartridge piercing receiving assembly and a supply end of said conduit, external to said gun, is adapted for connection to means for engaging a pressurized air source external to the gas-operated gun; and D. means for holding said seating end of the air conduit in air tight connection with said hollow piercing-needle of a cartridge piercing assembly.

2. The connector as recited in claim 1 wherein the means for engaging a pressurized air source external to the gas-operated gun comprises the supply end of the air conduit external to the gun being fixly held within a connector assembly engaged in a quick change coupler in communication with a pressurized air

3. The connector as recited in claim 2 further comprising a manifold having a plurality of threaded holes extending into a longitudinal cavity in threaded receipt of a corresponding plurality of quick change couplers, said manifold threadedly engaged to a threaded connector plug at a threaded end of the longitudinal cavity, and said connector plug engaged in a quick change coupler in communication with a pressurized air source external of said gun.

4. The connector as recited in claim 1 wherein the means for holding said air conduit in air tight connection with said hollow piercing-needle of a cartridge piercing assembly comprises a compression fitting mounted near the seating end of said air conduit so as to permit a portion of said air conduit to extrude outward beyond the planar face of said nose bushing, said compression fitting being adapted to receive two elastic o-rings, one at its upper portion and one at its lower portion, to secure the compression fitting within the passage bore of said nose bushing, and a third larger elastic o-ring seated upon a shoulder and surrounding a neck portion of said connector body for abutment against a bottom outer edge of the flange skirt of the cartridge piercing receiving assembly when said nose bushing is threadedly engaged to the annular inner wall of said flange skirt.

5. The connector as recited in claim 1 wherein said connector body is generally cylindrical in shape.

6. The connector as recited in claim 1 wherein said connector body is generally rectangular in shape.

7. A connector to an external air source for a gas-operated gun having a cartridge piercing receiving assembly, including a threaded flange skirt and a hollow cartridge piercing-needle, and a gun frame having an opening to permit extension of an air conduit from said hollow piercing-needle to a pressurized air source external of said gun, comprising:

A. a connector body having a passage bore;

B. a guide cap having a central bore at a substantially planar top surface and a threaded outer annular periphery, atop an outwardly extending brim flange, of sufficient diameter to threadedly engage an annular inner wall of a cartridge piercing assembly flange skirt;

C. a spout integral to one end of said connector body received into said guide cap by means for engaging said spout into said guide cap, said spout having a passage bore at least partially axially aligned with the passage bore of the connector body;

D. an air conduit extending through said axially aligned passage bores, a seating end of said conduit, internal to said gun, is adapted for communication with a hollow piercing-needle of the cartridge piercing receiving assembly through the central bore of the guide cap and a supply end of said conduit, external to said gun, is adapted for connection to means for engaging a pressurized air source external to the gas-operated gun; and E. means for holding said seating end of the air conduit in air tight connection with said hollow piercing-needle of a cartridge piercing assembly.

8. The connector as recited in claim 7 wherein said spout of the connector body is intregal to a tapered neck portion of the connector body and wherein the guide cap is contoured at its annular inner wall surface to at least two portions, an upper planar portion adapted to receive said spout and an outwardly tapered lower portion adapted to receive said tapered neck.

9. The connector body as recited in claim 8 wherein said means for engaging said spout into said guide cap comprises a base below said connector body having a threaded hole to threadedly receive an axially bored thumb screw adapted to permit extension of the air conduit through the tumb screw bore to a pressurized air source external of said gun, said thumb screw having a handle portion at least partially external to said gun frame and a tip base capable of engaging the bottom of said connector body for upward movement to secure said spout of the connector body within said guide cap upon threaded engagement of the thumb screw with the base.

10. The connector as recited in claim 8 wherein the means for engaging said spout into said guide cap comprises a spring upon a base for tension engagement with a planar rear bottom surface of the connector body to secure the spout of the connector body within the guide cap.

11. The connector as recited in claim 8 further comprising a manifold having a plurality of threaded holes extending into a longitudinal cavity in threaded receipt of a corresponding plurality of quick change couplers, said manifold threadedly engaged to a threaded connector plug at a threaded end of the longitudinal cavity, said connector plug engaged in a quick change coupler in communication with a pressurized air source external of said gun.

12. The connector as recited in claim 7 wherein the means for engaging the pressurized air source external to the gas-operated gun comprises the supply end of the air conduit external to the gun being fixly held within a connector assembly engaged in a quick change coupler in communication with a pressurized air source external of said gun.

13. The connector as recited in claim 7 wherein the means for holding said air conduit in air tight connection with said hollow piercing-needle of a cartridge piercing assembly comprises a compression fitting mounted near the seating end of said air conduit so as to permit a portion of said air conduit to extrude outward beyond the planar face of said spout, said compression fitting being adapted to receive two elastic o-rings, one at its upper portion and one at its lower portion, to secure the compression fitting within the passage bore of said spout.

14. The connector as recited in claim 7 wherein said connector body is generally cylindrical in shape.

15. The connector as recited in claim 7 wherein said connector body is generally rectangular in shape.

16. The connector body as recited in claim 7 wherein said means for engaging said spout into said guide cap comprises a base below said connector body having a threaded hole to threadedly receive an axially bored thumb screw adapted to permit extension of the air conduit through the thumb screw bore to a pressurized air source external of said gun, said thumb screw having a handle portion at least partially external to said gun frame and a tip base capable of engaging the bottom of said connector body for upward movement to secure said spout of the connector body within said guide cap upon threaded engagement of the thumb screw with the base.

17. The connector as recited in claim 7 wherein the means for engaging said spout into said guide cap comprises a spring upon a base for tension engagement with a planar rear bottom surface of the connector body to secure the spout of the connector body within the guide cap.

18. The connector as recited in claim 7 further comprising a manifold having a plurality of threaded holes extending into a longitudinal cavity in threaded receipt of a corresponding plurality of quick change couplers, said manifold threadedly engaged to a threaded connector plug at a threaded end of the longitudinal cavity, said connector plug engaged in a quick change coupler in communication with a pressurized air source external of said gun.

* * * * *